US011059062B2

(12) United States Patent
Adams et al.

(10) Patent No.: US 11,059,062 B2
(45) Date of Patent: Jul. 13, 2021

(54) AIRLESS ADHESIVE SPRAY GUN AND METHOD OF USE

(71) Applicants: Steven E. Adams, Richmond, VA (US); John C. Hannon, Richmond, VA (US); Terry Nelson, Richmond, VA (US); Ian L. Churcher, Richmond, VA (US); Andrew T. Sinclair, Richmond, VA (US)

(72) Inventors: Steven E. Adams, Richmond, VA (US); John C. Hannon, Richmond, VA (US); Terry Nelson, Richmond, VA (US); Ian L. Churcher, Richmond, VA (US); Andrew T. Sinclair, Richmond, VA (US)

(73) Assignee: Worthen Industries, Nashua, NH (US)

( * ) Notice: Subject to any disclaimer, the term of this patent is extended or adjusted under 35 U.S.C. 154(b) by 401 days.

(21) Appl. No.: 14/626,352

(22) Filed: Feb. 19, 2015

(65) Prior Publication Data

US 2015/0231655 A1 Aug. 20, 2015

Related U.S. Application Data

(60) Provisional application No. 61/941,952, filed on Feb. 19, 2014.

(51) Int. Cl.

| | |
|---|---|
| ***B05B 9/01*** | (2006.01) |
| ***B05B 12/00*** | (2018.01) |
| ***B05B 1/30*** | (2006.01) |

(52) U.S. Cl.

CPC ..... *B05B 9/01* (2013.01); *B05B 1/3046* (2013.01); *B05B 12/002* (2013.01)

(58) Field of Classification Search

CPC ..... B05B 9/01; B05B 1/3046; B05B 12/002; B05B 15/061

USPC ..... 239/526

See application file for complete search history.

(56) References Cited

U.S. PATENT DOCUMENTS

| | | | | |
|---|---|---|---|---|
| 4,560,109 | A * | 12/1985 | Teruyuki | F16J 15/3236 239/526 |
| 4,695,618 | A | 9/1987 | Mowrer | |
| 5,733,961 | A | 3/1998 | Purvis | |
| 6,276,616 | B1 * | 8/2001 | Jenkins | B05B 1/3046 239/526 |

(Continued)

FOREIGN PATENT DOCUMENTS

| | | |
|---|---|---|
| EP | 0814139 | 12/1997 |
| WO | 2014182170 | 11/2014 |
| WO | 2015137808 | 9/2015 |

OTHER PUBLICATIONS

Industrial Hydraulic Spray Products, Spraying Systems Co., 2013, pp. A3 & C24.

(Continued)

*Primary Examiner* — Jason J Boeckmann

(74) *Attorney, Agent, or Firm* — Lambert Shorten & Connaughton; David J. Connaughton, Jr.; Justin P. Tinger

(57) ABSTRACT

The present invention provides an airless adhesive spray gun that atomizes adhesive sprayed through it without the use of air atomization. This system provides numerous enhancements to the prior art including limiting overspray "fog," saving on sprayed material because of a more efficient spray pattern, and providing a stronger bond than that of the air-atomized spray guns of the prior art.

2 Claims, 8 Drawing Sheets

(56) References Cited

U.S. PATENT DOCUMENTS

| | | | | |
|---|---|---|---|---|
| 6,533,187 | B2 | 3/2003 | May | |
| 7,216,816 | B2 | 5/2007 | Hammarth | |
| 8,118,969 | B2 | 2/2012 | Williams | |
| 2006/0069196 | A1 | 3/2006 | Grabowski | |
| 2007/0224395 | A1 | 9/2007 | Rowitsch | |
| 2007/0272768 | A1 | 11/2007 | Williams | |
| 2008/0128083 | A1* | 6/2008 | Williams | C08L 11/02 156/333 |

OTHER PUBLICATIONS

No. AA23L-458B5 & No. AA23L45885-SS, Gunjet Spray Guns, Spraying Systems Co., Sheet 1.

* cited by examiner

AIRLESS ADHESIVE SPRAY GUN AND METHOD OF USE

BACKGROUND

When applying water-based adhesives by hand spray techniques of the prior art or automated/machine controlled spray techniques for assembly of cushioning materials, such as for the furniture and bedding industries, there is a problem with adhesive overspray. This is because the prior art teaches that water based adhesives are sprayed using air-atomized spraying systems. The overspray presents itself as a "fog" in the factory that can carry long distances from the actual application area of the factory. This fog also creates a nuisance dust health hazard for the employees. Lastly, the fog or overspray wastes resources as the adhesive is lost and not used for its intended purpose. This overspray not only gets onto the employees that apply the adhesive, but also contaminates nearby equipment, finished products or raw materials in inventory, air conditioners, heaters, and lighting.

One solution has been to set up air extraction hoods in the spray area. This works relatively well when the filters are maintained and the types of parts that are being assembled are small. However, when making larger items such as mattresses or large sofa cushions, the usefulness of an air extraction hoods is negated.

Also there have been attempts to control the overspray "fog" by using low fogging air-atomized guns such as the DUX or EasyFlow Laminair spray gun. Although these spray devices minimize the overspray when adjusted properly, they are dependent on the spray operators not adjusting the settings as they can easily be misadjusted and create fog.

Another solution has been to use different types of adhesive bases other than water base. Solvent-based adhesives and hot melt adhesives when sprayed do not create a "fog." These types of adhesives work well to eliminate the overspray but present other problems.

Solvent-based adhesives contain hazardous materials and often are flammable. They require air-extraction equipment to reduce the flammability hazard as well as the health hazards to employees. Also, solvent adhesives do not adhere to some types of visco-elastic foams.

Hot melt adhesives typically do not bond foam cushion substrates as well as water-based or solvent-based products. Hot melts also require melt tanks and heated hoses and this equipment is more expensive on a per gun basis than water-based or solvent adhesives.

Another solution is the roll coating of water-based adhesive rather than spray application. Roll coating eliminates the overspray, but suffers additional problems because the rollers are exposed to the atmosphere. As such, during any down time at all, the adhesive on the rollers can coagulate, causing inconsistent application of the adhesive. In addition, at the end of a shift, the workers must clean the rollers which adds to the system downtime and taking away working time from the workers. Further still, rollers do not allow a control of the application rate over a surface. Although roll coating provides a consistent application of adhesive across an entire surface, sometimes it is advantageous to vary the application rate of the adhesive. For example, it may be advantageous to use more adhesive in one area and less in another, thereby using less adhesive overall.

SUMMARY

The subject matter of this application may involve, in some cases, interrelated products, alternative solutions to a particular problem, and/or a plurality of different uses of a single system or article.

In one aspect, the present invention comprises an airless adhesive spray gun system. The system may have an airless adhesive spray gun, and a quantity of water-based adhesive connected to the spray gun. The spray gun comprises a handle, a trigger attached to the handle which controls the position of an actuating needle, the needle being movable between a closed position and an open position. The spray gun further comprises an adhesive inlet port through which the quantity of adhesive is connected, a nozzle interior portion comprising an inlet end, outlet end, and an interior, the interior having an increased width portion, an orifice, and a needle seat configured to sealingly receive the actuating needle when the needle is in the closed position, the needle exposing the orifice when in an open position, allowing flow of the adhesive through the orifice. As noted, the quantity of adhesive is connected to the airless adhesive spray gun through the adhesive inlet port, the quantity of adhesive being a water-based adhesive, a pressurizing structure providing the quantity of adhesive to the airless adhesive spray gun under pressure of less than 150 psi. The nozzle configuration, as well as gun structure such as a nozzle interior portion, is such that it atomizes a quantity of adhesive as the adhesive passes through the nozzle orifice when provided to the airless adhesive spray gun at a pressure of under 150 psi.

In another aspect, a mechanized, or automated, airless adhesive spray gun system is provided. The mechanized system may have an airless adhesive spray gun and a quantity of adhesive connected to the spray gun. The spray gun comprises a mechanically controlled handle, a mechanically controlled trigger, the trigger controlling the position of an actuating needle, the needle movable between a closed position and an open position. The spray gun further comprises an adhesive inlet port, through which the quantity of adhesive is connected, a nozzle interior portion comprising an inlet end, outlet end, and an interior, the interior having a substantially straight fluid flow portion, an orifice, and a needle seat configured to sealingly receive the actuating needle when the needle is in the closed position, the needle exposing the orifice when in an open position, allowing flow of the adhesive through the orifice. In some embodiments, the nozzle interior portion orifice may be formed as part of the needle seat. As noted, the quantity of adhesive is connected to the airless adhesive spray gun through the adhesive inlet port, the quantity of adhesive being a water-based adhesive, a pressurizing structure providing the quantity of adhesive to the airless adhesive spray gun under pressure of less than 150 psi. The nozzle, nozzle interior portion, and spray gun configuration is such that it atomizes a quantity of adhesive as the adhesive passes through the outer nozzle orifice when provided to the airless adhesive spray gun at a pressure of under 150 psi.

DETAILED DESCRIPTION

Figure 1:
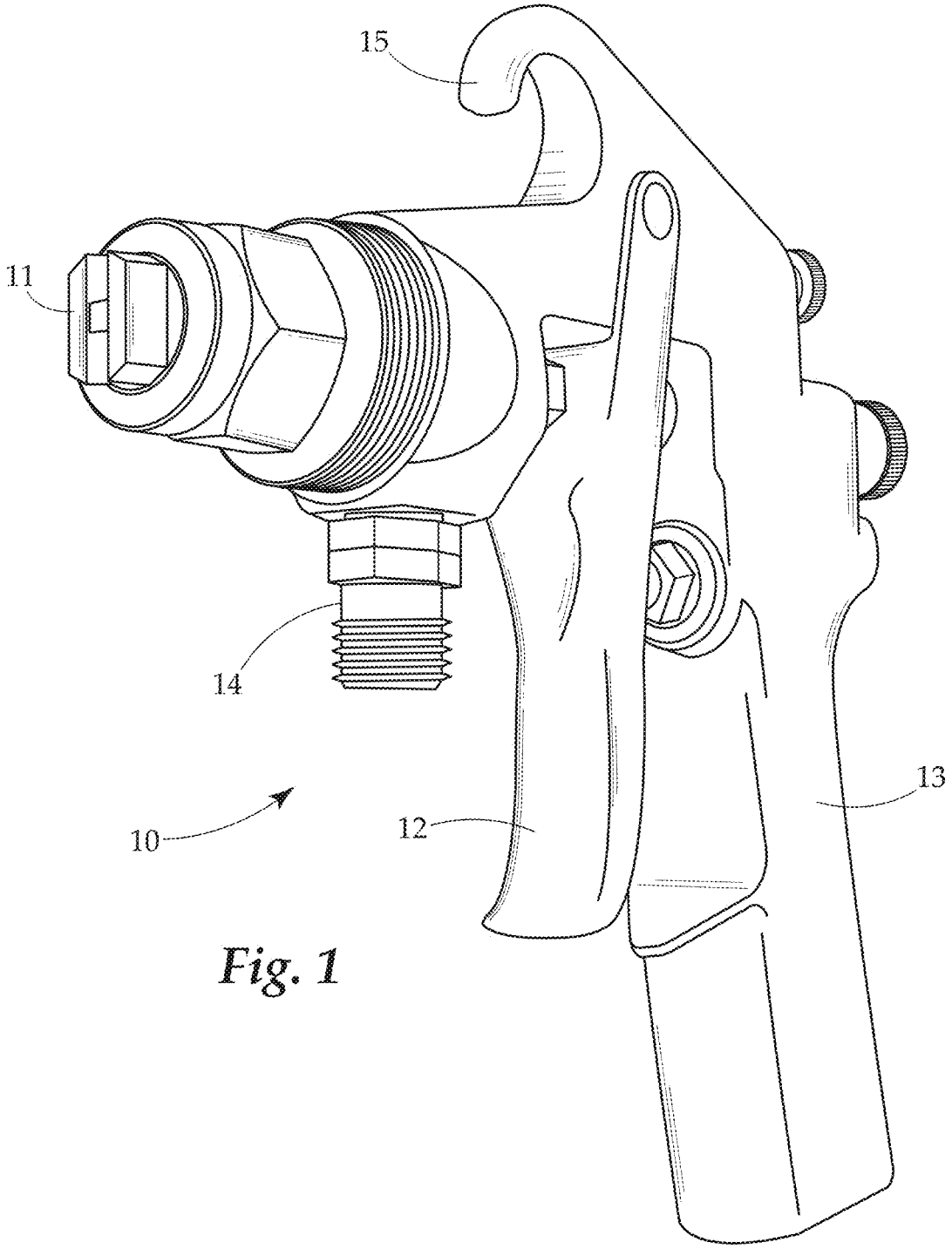
FIG. 1 provides a perspective view of an embodiment of the one-component airless adhesive spray gun of the present invention.

The present invention concerns a water-based adhesive that can be applied by "airless" spray techniques. In one embodiment, this adhesive can be supplied in a ready to use aerosol can. The can may use bag-in-can technology, or the adhesive may be stored directly within the container. In a bag-in-can embodiment, the adhesive is injected into the bag. The bag is placed inside of a can that can hold pressure. In the space between the bag and the can, nitrogen or carbon dioxide or some other gas is inserted until sufficient pressure is reached to cause the adhesive to be expelled and atomized properly. In other embodiments, the adhesive can be supplied by bulk means and pumped, pressure pot-supplied, or by other similar pressurizing structure provided, to an "airless" spray gun. For example, bulk containers sized between one gallon to a tank wagon-sized container may be used. The adhesive may be stored directly in the tanks (as opposed to in a "bag-in-a-can" embodiment). The adhesive in the tank is provided in either pressurized or non-pressurized containers. The tank is connected to the spray gun by at least one hose and the adhesive is pumped or otherwise provided under pressure to the spray gun to provide the pressure required for operation.

Generally it is the case for sprayed adhesives that the better an adhesive works to adhere, the worse it performs in a sprayed application. This is because the application of pressure, as well as the shear forces caused by forcing the adhesive through piping, spray gun internal flow paths, and a spray nozzle, all cause the adhesive to coagulate and start acting as an adhesive as opposed to a fluid. The air-atomized spray guns used in the prior art seek to limit the forces on the adhesive by using air atomization, and using low pressure feeds. An airless spray gun/system only magnifies the problems faced above: Airless spray guns and systems use higher pressure, have faster moving fluid (causing higher shear forces), and force the adhesive through a very small hole to cause it to atomize without the use of an air curtain or air stream. As such, airless spray guns have not been considered as an option in this field. The present invention unexpectedly overcomes these issues, using an airless spray gun with a specially designed adhesive to achieve airless spraying without the downfalls that would normally be expected and, further, resulting in a process that overcomes the issues of air-atomized spray guns, namely overspray.

The atomization of the adhesive is caused when the adhesive is expelled through the airless gun tip that atomizes and spreads the adhesive into a controlled spray pattern. This is in contrast to an air-atomized spray gun which atomizes the adhesive using an air stream or air curtain. The airless spray gun and adhesive sprayed through it eliminates the problem of overspray fog seen in the prior art. In particular, it has been observed that the present invention saves 30-40% of adhesive used compared to air-atomized spray guns, in large part because of the elimination of this overspray. While typical airless spray guns operate at 300 psi or above, the present invention achieves an airless spray at under 150 psi. In a particular embodiment, the present invention achieves an airless spray at approximately 20-60 psi. In a particular embodiment, the spray gun may achieve spray at an interior pressure of approximately 20-40 psi. In another particular embodiment, the spray gun may operate at an interior pressure of approximately 20-25 psi. The pressure is provided to the adhesive by some sort of pressurizing structure, which could be the adhesive stored under pressure, a pump, gravity, or any other structure or system that may provide a fluid under pressure. It has also been observed that bonding is faster and stronger with the present airless spray gun adhesive application than in the air-atomized spray gun found in the prior art. This may be because of larger droplets in the airless spray gun system (compared to an air-atomized system), which penetrate further into the material to be bonded, resulting in a stronger bond at a lower adhesive application rate. The strength of this bonding can be seen in the chart provided in FIG. 10.

In further embodiments, the airless spray gun may be replaced with a mechanized or automated spraying machine. In this embodiment, the spray device may be automated, as opposed to controlled by a person using a hand spray gun. In this embodiment, sensors such as optical, location-based, thermal, and the like, may control the activation of the spray nozzle, activating the spraying onto the desired surface. Robotic assembly may also be involved in these embodiments. It may be particularly important to avoid overspray in mechanized embodiments because the expensive machinery will be fouled by the adhesive cloud, jamming the machinery and otherwise leading to wear and tear or malfunction.

Typically the water-based adhesives that are designed to work for foam fabricating tend to have reduced mechanical stability. This foam fabricating may be performed in the present invention as wet bonding, allowing more rapid assembly of the adhered components so that there is no waiting time between spraying and adhering, which there would be if the adhesive had to dry to be operational. This reduction in mechanical stability causes many water-based adhesives to clog or coagulate when pumping or pressure-pot delivering to spray guns. Also, the small size of the airless spray nozzles causes the nozzles to clog and therefore not spray consistently or effectively. As such, water based adhesives, particularly for foam adhesion and other product manufacturing processes including lamination adhesion processes (such as assembly of counter tops, and the like) are not used in airless spray applications.

However, the adhesive used herein is mechanically stable enough to withstand the mechanical shear forces encountered with airless spraying, yet it has enough instability to work in the application by providing instant grab or tack.

It is known that water-based glues that work in this market are not stable enough to be sprayed using airless technology. Also the viscosities of current adhesives tend to be too high to atomize well using airless technology. They also tend to clog the nozzles of the airless gun as well as coagulate inside the airless gun due to the higher shear forces encountered during the airless spraying.

When using airless guns to deliver our water-based adhesive, the overspray fog is eliminated. Spray operators are not exposed to "nuisance dust" hazards. The factory, equipment, inventory, lighting and air-handling systems remain adhesive free. Also it was unexpectedly found that the final bonding of the adhesive was faster when sprayed using airless guns than with air-atomized guns. Further, airless spray guns are limited to have minimal or no adjustments that a spray operator can easily make to the spray device. This eliminates the problems associated with the adjustments that can be made with air-atomized spray guns. Air-atomized spray guns can have the following adjustments: Atomization air, fan width air, and fluid needle. Any changes in these adjustments can cause overspray fogging or over-application of adhesive.

The adhesive is selected and intended for use in the present invention is a water-based dispersion with no co-solvents. The spray gun, and particularly the nozzle therein, is configured to carefully destabilize the selected dispersion so that it coagulates very quickly with shear forces from the spraying process. In many cases, this destabilization prevents similar adhesives from being used with an airless spray gun. However, the particular water-based dispersion selected is resilient enough to maintain its flow properties under the shear forces of the spraying. Further, the water-based dispersion adhesive selected and used herein in the airless spray gun has a low viscosity and is somewhat more stable to shear forces than other formulations known in the art. However, the adhesive used herein also has enough instability to cause the emulsion to break quickly after spraying under the shear forces from the nozzle of the spray gun. This breaking allows the adhesive to be able to adhere quickly and hold strongly enough for its applications. In one embodiment, the adhesive may be used in foam fabrication such as that used in the furniture and bedding industries.

Particularly, the adhesive contemplated herein is a polychloroprene latex base that can have other lattices such as styrene butadiene rubber (SBR), Acrylic, Vinyl Acetate Ethylene (VAE), Poly-Vinyl Acetate (PVA), Vinyl Acrylic, Nitrile, and the like added as well. A pH of the adhesive is lowered using Glycine, or other acid such as glycolic, lactic, citric, ascorbic, boric, and the like. Stabilizers are further added. The stabilizers may be any of: Anionic soaps, non-ionic surfactants, polymeric thickeners, and water. In a particular embodiment, the adhesive used herein may be Fabond 1226, 1404, or equivalent from Worthen Industries.

The unique nozzle of the present invention may be configured to allow a metal needle of the spray gun to fit into a metallic seat of the nozzle. This allows the adhesive to be more closely controlled without being damaged or deformed during operation. While other materials may be used to seat the needle of the spray gun as long as the needle moves perpendicularly to the nozzle opening, metal has been determined to be superior, particularly over the life of the spray gun. However, in another embodiment, a plastic material may be used to form the entire interior nozzle, therefore the present invention is not limited to a metallic seat for the nozzle. Generally, the needle and seat may be configured in any manner to prevent leakage of a lower viscosity adhesive that is also capable of providing a clean seal when stopping the spraying process. As noted above, the prior art teaches that adhesives of the types described above cannot be used in airless spray gun applications because they are not stable enough to withstand the shearing forces of the spray gun without coagulating and jamming the spray gun. However, it has been unexpectedly observed that with a proper balance of adhesive properties, an airless spray gun may indeed be used with the right adhesive, proper nozzle sizing and spray gun configuration. In a particular embodiment, the nozzle may have an inner orifice and outer spray tip. This nozzle may have an outer spray tip orifice size of approximately 0.127 mm to 1.35 mm. In a further embodiment, the outer spray tip orifice size may be approximately 0.66 mm. In some embodiments, the orifice may have an orifice outer size of 0.28 mm to 5.16 mm (0.011"-0.203") measured horizontally across the nozzle when straight up and down. In a particular embodiment the orifice outer size may be approximately 0.51 mm-0.76 mm (0.020"-0.030"). The nozzle may be angled to provide a desired pattern and pattern width at a certain distance. Some non-limiting examples of nozzle angle include 110, 95, 80, 73, 65, 50, 40, 25, and 15 degrees.

In one embodiment, a spray gun configured for air-atomization was modified to be an airless spray gun by using a nozzle having orifice sizes within the ranges noted above, as opposed to the larger orifice sizes used in air-atomized spray guns. The specially selected adhesive was then used through this particular modified spray gun, yielding positive results. Many air-atomized spray guns have larger internal fluid (adhesive) flow paths than their airless counterparts, as such, this aided in the airless spraying by exposing the adhesive to fewer shear forces.

In summary, the present invention involves a combination of adhesive formulation, with the modification of an airless spray gun in order to come up with a unique invention. The problems of water-based airless sprays are numerous such as: Corrosion to the container that ruins the adhesive, problems with gun tip cleanliness, incompatibility with propellants, need for high solids for fast drying, the need for high pressure, typically above 300 psi to achieve atomization (which will immediately destabilize a water based one-component adhesive-clogging the spray gun), valve seat leakages, clogging of spray gun internal chambers, and the like. The combination of our adhesive with the modified gun has solved all of the problems with airless spray and has also solved the overspray issue seen in the air-atomized spray guns for product assembly where adhesive is applied to one or both surfaces to be bonded and the parts are either immediately put together or are allowed to dry some period of time before assembly.

Figure 2:
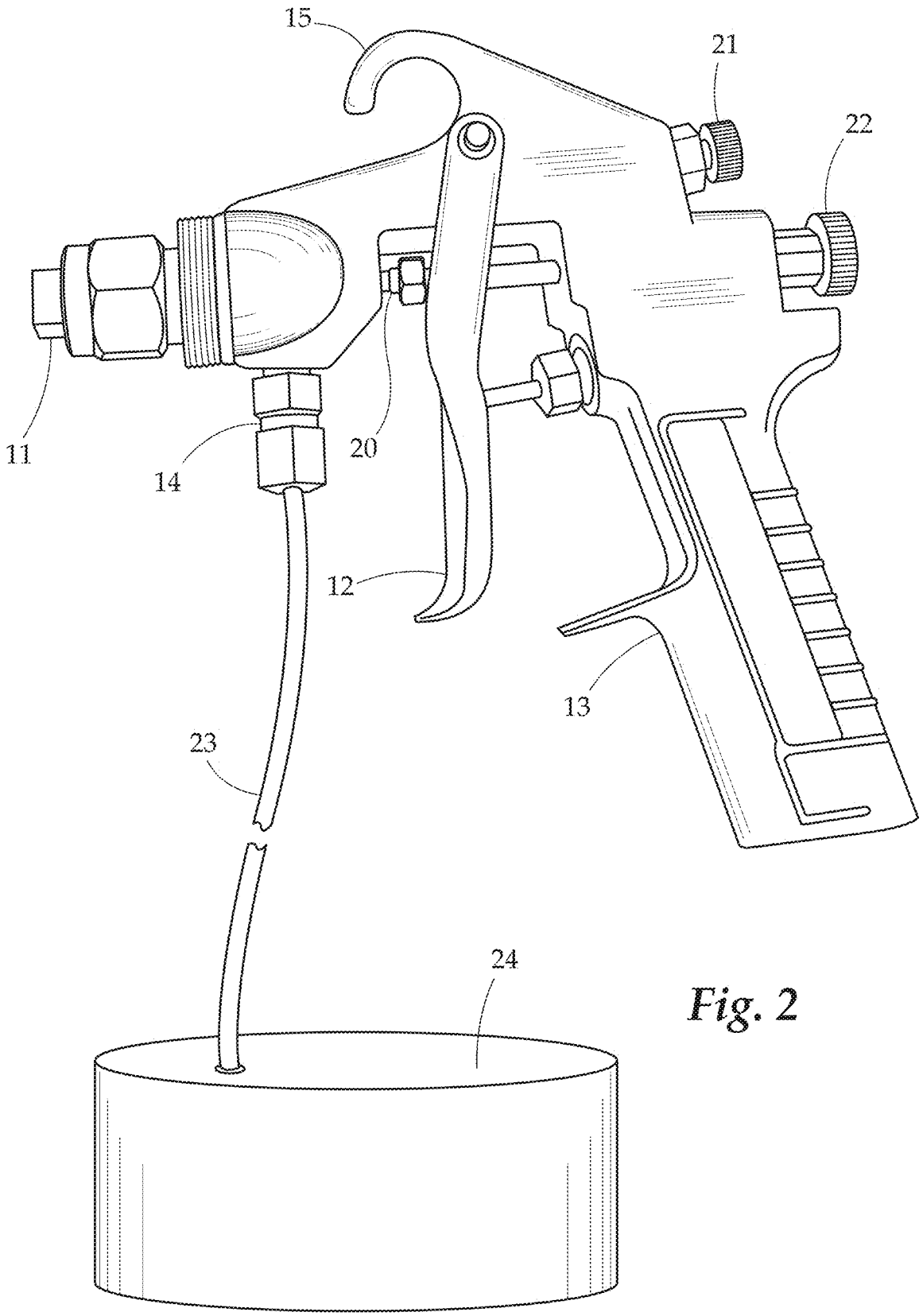
FIG. 2 provides a side view of an embodiment of the one-component airless adhesive spray gun of the present invention.
Figure 3:
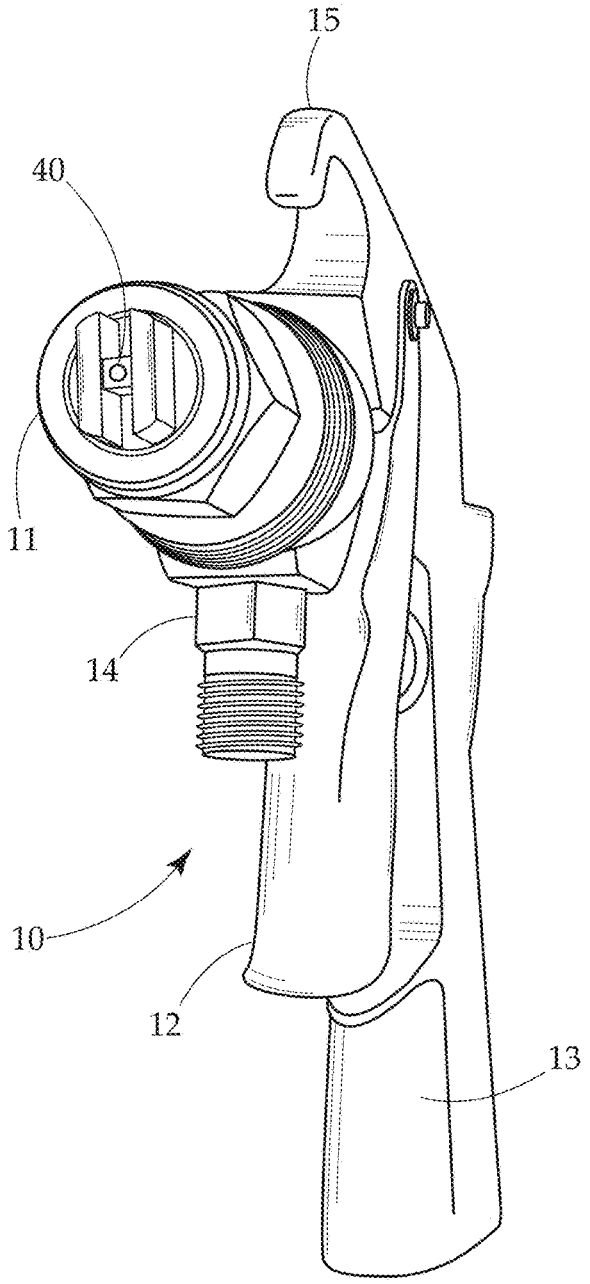
FIG. 3 provides a front perspective view of an embodiment of the one-component airless adhesive spray gun of the present invention.
Figure 4:
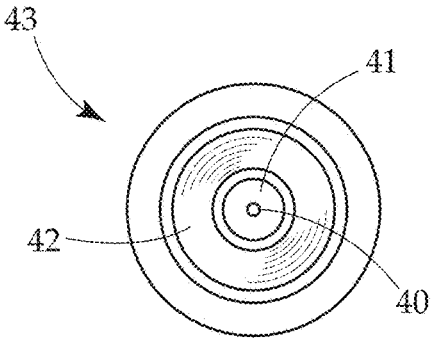
FIG. 4 provides an end view of an embodiment of the nozzle interior portion and orifice.
Figure 5:
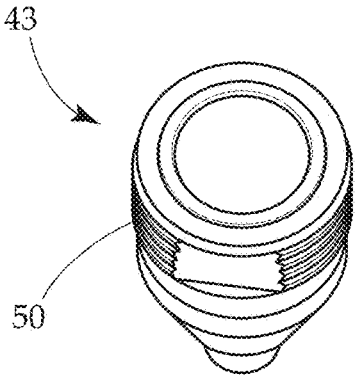
FIG. 5 provides a perspective view of an embodiment of the nozzle interior portion.

Turning now to FIGS. 1, 2, and 3, various views of an embodiment of the one-component airless adhesive spray gun are provided. The one-component airless adhesive spray gun 10 ("spray gun") has a handle 13 providing structure to the body of the spray gun. A trigger 12 is movably positioned on the handle 13 and is biased by a spring assembly to a forward position blocking flow through the orifice of the nozzle. Upon depression of the trigger 12, an actuating needle 20 is drawn back, allowing flow of a one-component adhesive through nozzle 11, namely nozzle orifice 30, atomizing the adhesive. A hook 15 protrudes from a top of the handle 13. This hook 15 allows the spray gun 10 to be hung, or otherwise secured when not in use, or to be easily secured in place for fixed-use applications. The one-component adhesive for the airless gun 10 enters the spray gun through the one-component adhesive connector port 14. Control knob 22 may allow fine tuning of spray conditions. A quantity of adhesive 24 under pressure is connected to the adhesive connector port 14 by a hose 23.

Figure 6:
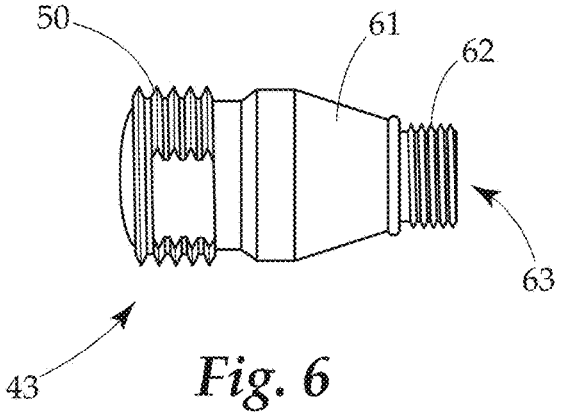
FIG. 6 provides a side view of an embodiment of the nozzle interior portion.
Figure 7:
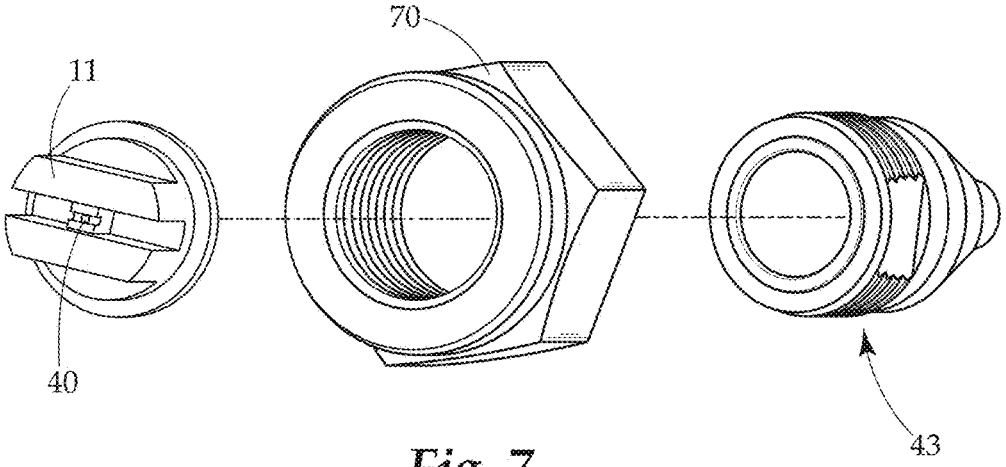
FIG. 7 provides a perspective exploded view of an embodiment of the nozzle assembly.

FIGS. 4, 5, 6, and 7 provide various views of the nozzle internal component. The nozzle internal component 43 forms an orifice 40 through which the one-component airless adhesive is forced. While passing through this orifice 40, the adhesive passes to nozzle 11 and is atomized through orifice 30, and thus sprayed. A needle seat 41 allows the needle to flushly seat into the orifice and seat when the needle is in a closed position. Inner face 42 is formed to properly urge the adhesive fluid flow into and through the orifice 40 without excessive shearing. The nozzle interior component 43 has two threaded regions 50 and 62 which allow the nozzle to be secured in place to the spray gun 10. It should be understood, however, that any similar connection structure may be used in place of the threaded connections. As seen in FIG. 6 in particular, the inlet end 63 is narrower than the outlet end, and has an increased width portion 61 along its body. On an interior flow path of the inner nozzle 43, a fluid passage moving from inlet end 63 to outlet orifice 40 is a straight flow path, having an approximately consistent diameter. This consistent diameter flow path tapers inward immediately before the orifice 40. This tapering may form the nozzle seat, may be stepped, a portion of which is the nozzle seat, or other similar configuration. The configuration of the nozzle 11 and nozzle interior component 43 can be seen in FIG. 7, which shows the assembly in an exploded position. It should be understood, however, that the interior flow path is not limited to this straight path embodiment. It can be seen that a retaining nut 70 holds the nozzle 11 and nozzle interior component 43 together. However, it should be understood that any similar configuration may be used without straying from the scope of the present invention.

Figure 8:
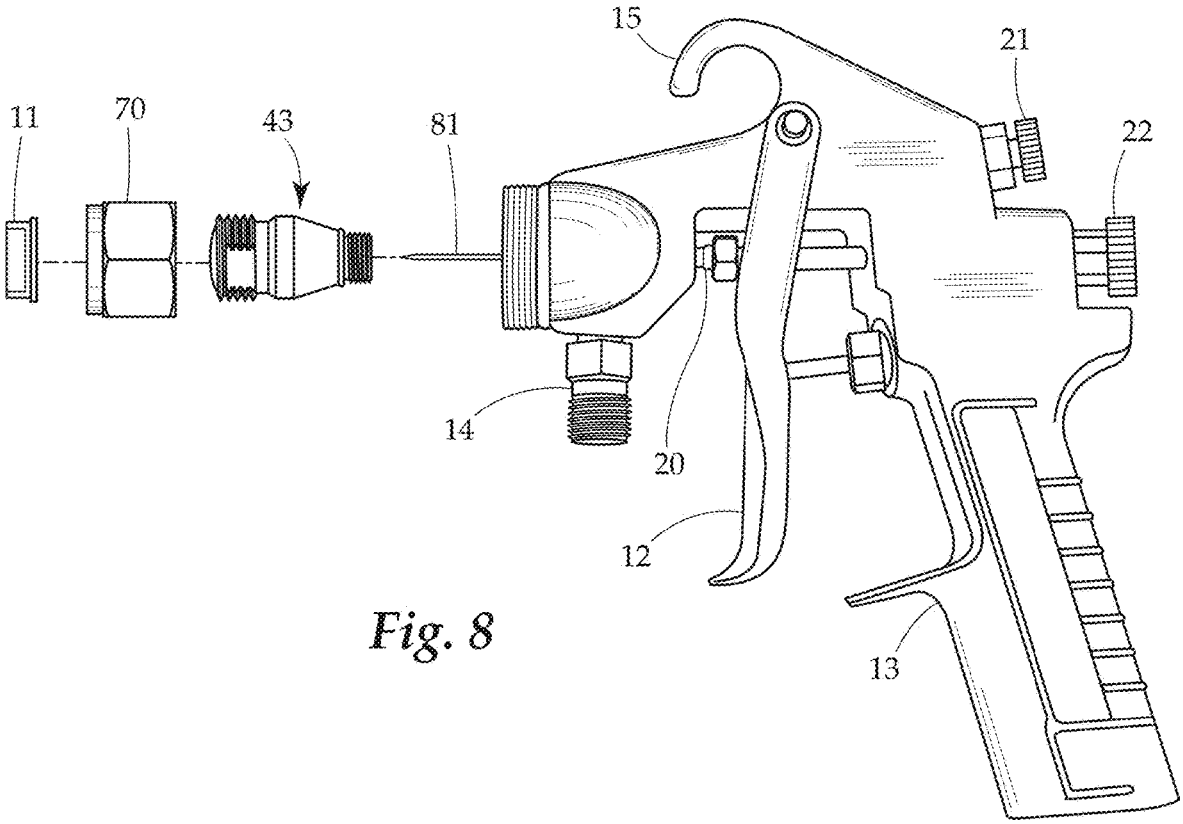
FIG. 8 provides a partially exploded side view of an embodiment of the one-component airless adhesive spray gun.

FIG. 8 provides a side view of a partially exploded airless adhesive spray gun. In this view, the control needle proximal end 81 can be seen. When installed, this needle seats into the seat 41 of the nozzle interior component 43.

Figure 9:
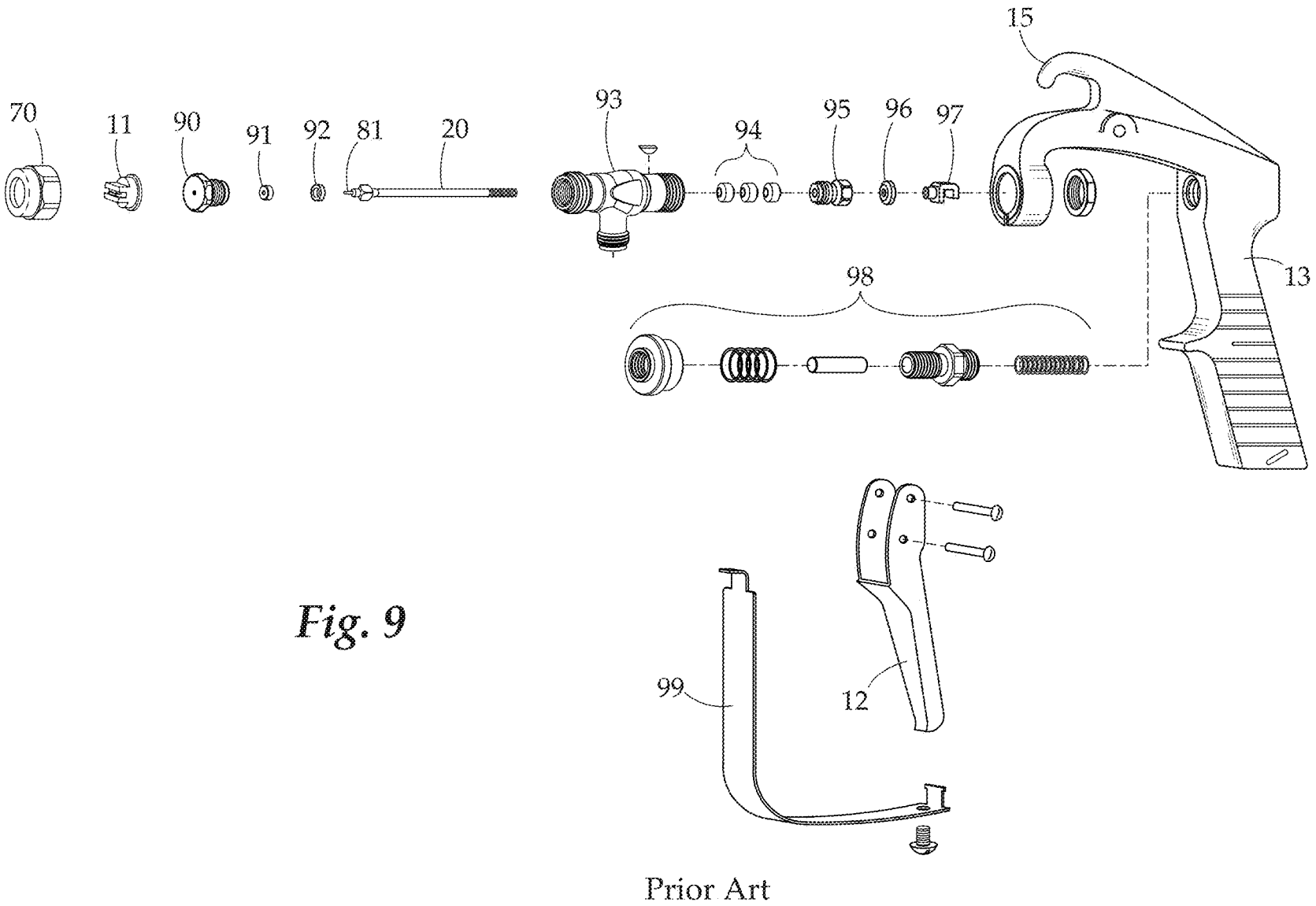
FIG. 9 provides an exploded side view of a prior art embodiment of the one-component airless adhesive spray gun.

FIG. 9 provides a side perspective view of an exploded prior art airless adhesive spray gun. This spray gun is typically used with solvent based adhesives, and cannot be used with a water-based one component adhesive because it requires pressures that destabilize and coagulate the adhesive, and also because the flow paths within the gun cause excessive shearing again destabilizing and coagulating the adhesive. The handle 13 provides the base for the structure. A plurality of connecting elements 94, 95, 96, 97 seat within the handle to connect the spray body housing 93 to the handle 13. One particular issue with this prior art gun is that the spray body housing 93 contains internal flow paths which destabilize the adhesive. A trigger spring assembly 98 also seats within the handle, which biases the trigger 12 in the forward position, the trigger being depressible against the force of the spring assembly 98. Actuating needle extends from the trigger 12 to being seated in the nozzle interior portion 90 at its proximal end 81. In this embodiment, nozzle interior portion 90 is shown in a slightly different embodiment. Gaskets 91, 92 may be positioned between the actuating needle and nozzle interior portion to facilitate the seal of the needle in its seat. Nozzle 100 is positioned in front of the interior portion 90. The retaining nut 70 holds the elements in position with the spray body housing 93. Finally, in this embodiment, hand guard 99 is removably attachable to the handle 13. The spray gun of the present invention is modified from the prior art gun of FIG. 9 to, among other things, provided a flow with lower shear on fluid flow, to operate at a lower pressure, and to have a superior interior nozzle (compare 90 to 43) allowing for better fluid flow at lower pressure, and providing a superior needle seat, preventing leaking and providing more precise control.

Figure 10:
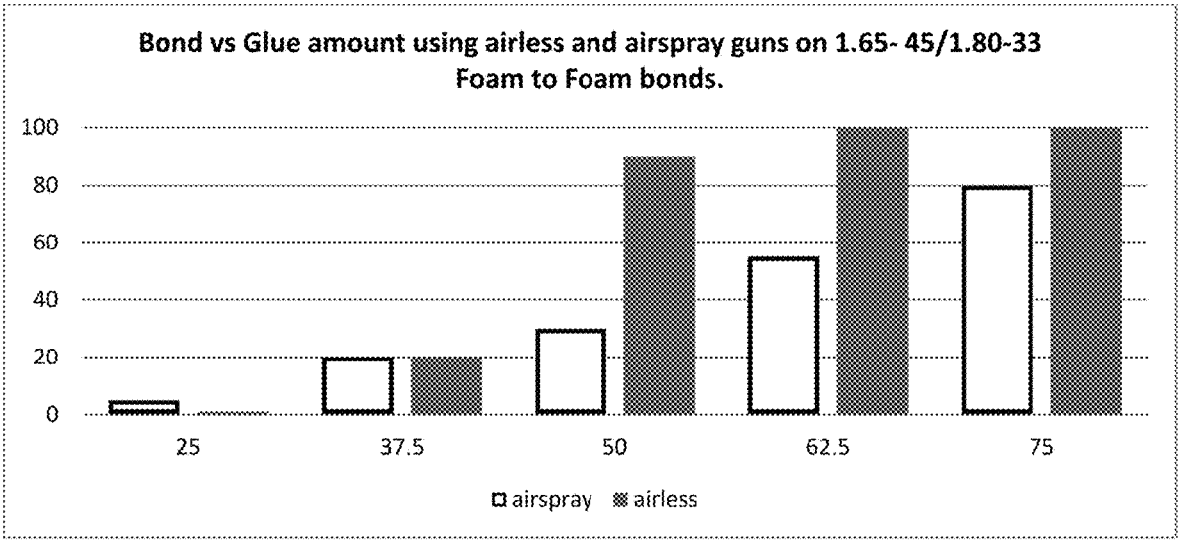
FIG. 10 provides a chart of the unexpected stronger bond strength when using an airless adhesive spray gun compared to an air-atomized spray gun.

FIG. 10 provides a chart of the unexpected stronger bond strength when using an airless adhesive spray gun compared to an air-atomized spray gun. This chart demonstrates that adhesive bonds between two foams adhered using adhesive sprayed from the airless adhesive spray gun of the present invention have a notably stronger bond strength than the same foams adhered using the same adhesive sprayed from the prior art air-atomized spray guns. In particular, it can be seen that bonds between two foams (1.65 pound density, 45 pound indentation force deflection (IFD) rail foam bonded to 1.80 pound density, 33 pound IFD core foam) are stronger for adhesive sprayed from the present invention compared to the prior art air-atomized spray guns. The vertical axis percentage shows foam tear (the higher the foam tear, the higher the bond strength), while the horizontal axis shows the wet adhesive application rate in grams/yd$^2$. The greatest differential in application strength between the airless and air-atomized systems is seen at 50 grams/yd$^2$ adhesive. However, it should be understood that the application density may vary widely depending on intended application. The present invention is in no way limited to an adhesive application density.

Figure 11:
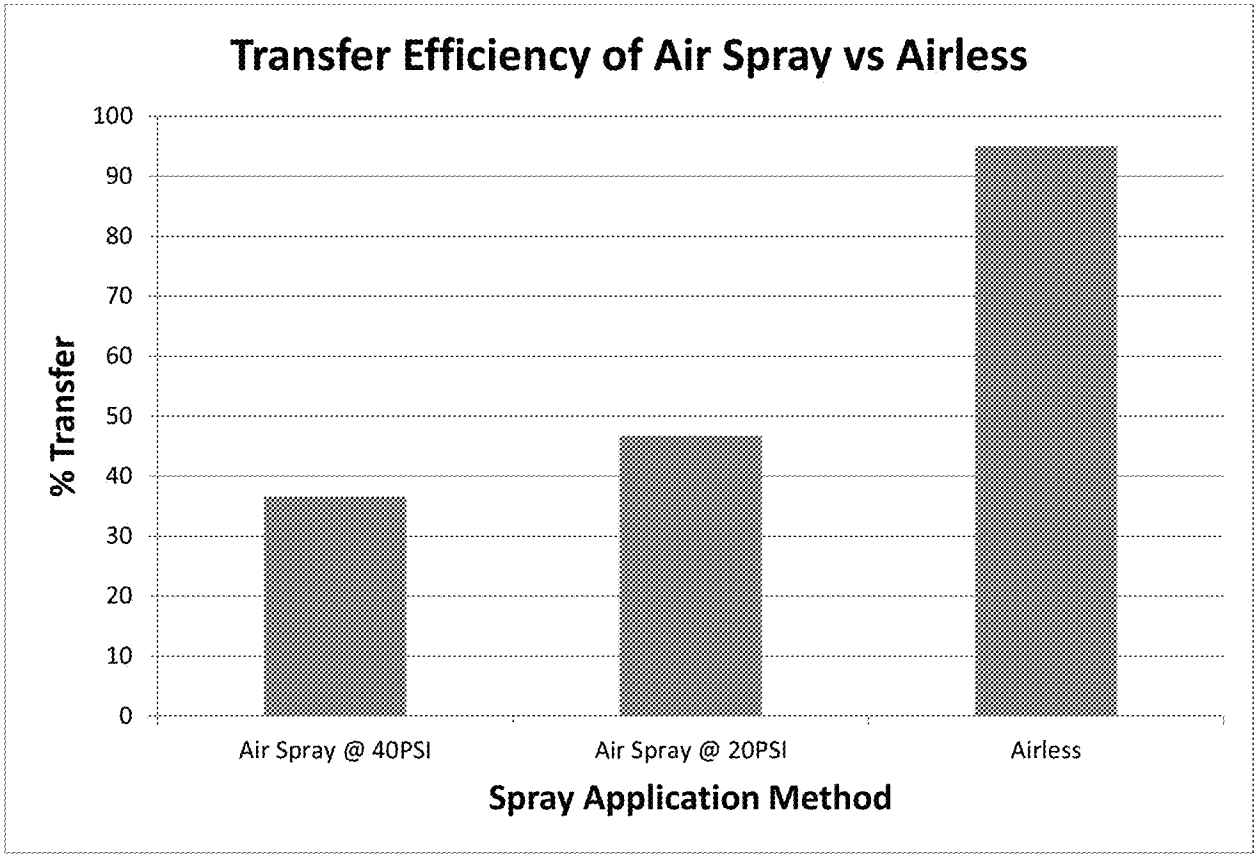
FIG. 11 provides a chart of transfer efficiency of an airless adhesive spray gun compared to an air-atomized spray gun.

FIG. 11 provides a chart of spray transfer efficiency for the airless spray gun system of the present invention compared to air-atomized spray guns of the prior art. This test was performed by spraying a known mass of adhesive through each spray gun onto a foam target. The foam target was weighed before and after testing, and its mass change compared to the mass of adhesive sprayed through the nozzle. Repeated testing yielded such results. It can be seen that for the airless spray gun system of the present invention, the transfer efficiency is 97%. Whereas the air-atomized spray guns of the prior art provide only a 36.6% transfer at 40 psi, and a 46.7% transfer at 20 psi. The remaining adhesive from the air-atomized spray guns is wasted and largely turned into 'fog'. The adhesive waste results in the need for more adhesive through the spray gun, longer spraying times, and more difficult work environment compared to the use of the airless spray gun of the present invention.

Figure 12:
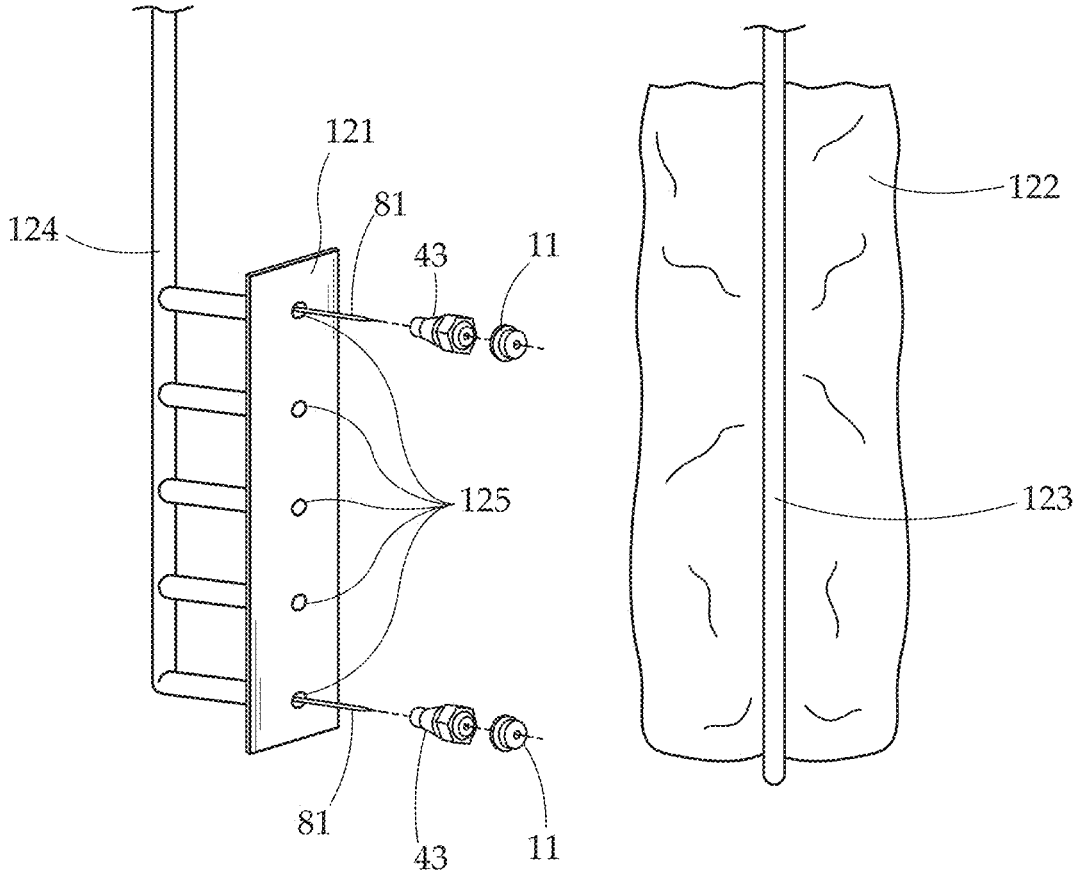
FIG. 12 provides a view of an embodiment of a mechanized spray gun configuration for use in a spray system with a foam or other material positioned on a conveyor.

FIG. 12 provides a view of an embodiment of a mechanized spray gun configuration. In this view, a foam 122 is positioned on a conveyor 123. The conveyor moves the foam in a direction into and out of the page. A plurality of spray nozzles 125 are positioned on a support body 121. Adhesive flow is provided through flow paths 124. This flow path may be through piping, tubing, and the like, and may be any configuration to provide fluid flow to each of the spray nozzles. Within the support body may be components similar to the spray gun of the prior figures, including needle 20, 81, nozzle interior portion 43, and the like. Moreover, in one embodiment, the needle actuation and positioning (which controls the spray through each nozzle 125) may be controlled by a mechanized, automatic system, such as a computer controlled electronic or pneumatic needle movement. In this view, two of the plurality of the control needle proximal ends 81 can be seen. When installed, this needle 81 seats into the seat 41 of the nozzle interior component 43. The nozzle internal component 43 forms an orifice 40 through which the one-component airless adhesive is forced. While passing through this orifice 40, the adhesive passes to nozzle 11 and is atomized through orifice 30, and thus sprayed.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention and are inclusive, but not limited to, the following appended claims as set forth.

What is claimed is:

1. An airless adhesive spray gun system comprising: an airless adhesive spray gun configured to spray only one component comprising: a handle; a trigger attached to the handle, the trigger controlling the position of an actuating needle, the needle movable between a closed position and an open position; a nozzle internal component connected to the handle comprising an interior, an inlet end attached to the airless adhesive spray gun, and an outlet end, an orifice at the outlet end, and a needle seat configured to sealingly receive the actuating needle when the needle is in the closed position, the needle passing through the nozzle internal component interior, exposing the orifice when in the open position; a nozzle, the nozzle having a second orifice aligned with the orifice of the nozzle internal component, the nozzle attached to the nozzle internal component; and the nozzle internal component consisting of a single inlet port in communication with the second orifice of the nozzle, and consisting of a single outlet at the orifice, the single inlet port and orifice being the only inlet or outlet to the nozzle interior portion; a quantity of adhesive connected to the airless adhesive spray gun by a connector port formed into to the handle, a flow path passing through the spray gun handle, and into and through the inlet port, the quantity of adhesive being a water-based adhesive, a pressurizing structure providing the quantity of adhesive to the airless adhesive spray gun under a pressure of less than 150 psi; wherein only the single inlet port provides fluid communication to the nozzle interior, orifice, and nozzle second orifice, the nozzle configured to atomize a quantity of adhesive as it passes through the orifice when the adhesive is provided to the airless adhesive spray gun at the pressure of under 150 psi; wherein the nozzle second orifice has an outer size of approximately 0.28 mm to 5.16 mm; wherein the quantity of adhesive is a water-based adhesive having a polychloroprene base; and wherein the water-based adhesive having a polychloroprene base does not contain polymeric microspheres.

2. An airless adhesive spray gun system comprising: an airless adhesive spray gun configured to spray only one component comprising: a handle; a trigger attached to the handle, the trigger controlling the position of an actuating needle, the needle movable between a closed position and an open position; a nozzle internal component connected to the handle comprising an interior, an inlet end attached to the airless adhesive spray gun, and an outlet end, an orifice at the outlet end, to sealingly receive the actuating needle when the needle is in the closed position, the needle passing through the nozzle internal component interior, exposing the orifice when in the open position; a nozzle, the nozzle having a second orifice aligned with the orifice of the nozzle internal component the nozzle attached to the nozzle internal component by a retaining nut; and the airless adhesive spray gun consisting of a single inlet port, the single inlet port and orifice being the only sources of fluid communication to the interior of the nozzle internal component; wherein the needle seat is a metallic seat, and wherein the needle is a metallic needle; and wherein the nozzle second orifice has an outer size of approximately 0.28 mm to 5.16 mm; a quantity of adhesive connected to the airless adhesive spray gun by a connector port formed into to the handle, a flow path passing through the spray gun handle, and into and through the inlet port, the quantity of adhesive being a water-based adhesive, a pressurizing structure providing the quantity of adhesive to the airless adhesive spray gun under a pressure of approximately 20-40 psi; wherein the adhesive inlet port provides fluid communication to each of the plurality of nozzle interior portions, each of the plurality of nozzles configured to atomize a quantity of adhesive as it passes through the orifice when the adhesive is provided to the airless adhesive spray gun at the pressure of approximately 20-40 psi; and wherein the water-based adhesive having a polychloroprene base does not contain polymeric microspheres.

* * * * *